US009758968B2

(12) United States Patent
Leinenbach et al.

(10) Patent No.: US 9,758,968 B2
(45) Date of Patent: Sep. 12, 2017

(54) METHOD FOR BUILDING PRESTRESSED CONCRETE STRUCTURES BY MEANS OF PROFILES CONSISTING OF A SHAPE-MEMORY ALLOY, AND STRUCTURE PRODUCED USING SAID METHOD

(71) Applicants: RE-FER AG, Wollerau (CH); EMPA, Dubendorf (CH)

(72) Inventors: Christian Leinenbach, Fehraltdorf (CH); Masoud Motavalli, Forch (CH); Benedikt Weber, Winterthur (CH); Wookjin Lee, Dubendorf (CH); Rolf Brönnimann, Wiesendangen (CH); Christoph Czaderski, Gossau (CH)

(73) Assignees: re-Fer AG, Wollerau (CH); EMPA, Dubendorf (CH)

( * ) Notice: Subject to any disclaimer, the term of this patent is extended or adjusted under 35 U.S.C. 154(b) by 0 days.

(21) Appl. No.: 14/783,359

(22) PCT Filed: Mar. 17, 2014

(86) PCT No.: PCT/CH2014/000030

§ 371 (c)(1),
(2) Date: Oct. 8, 2015

(87) PCT Pub. No.: WO2014/166003

PCT Pub. Date: Oct. 16, 2014

(65) Prior Publication Data

US 2016/0053492 A1 Feb. 25, 2016

(30) Foreign Application Priority Data

Apr. 8, 2013 (CH) ..... 732/13

(51) Int. Cl.
*E04C 5/08* (2006.01)
*E04G 21/12* (2006.01)
(Continued)

(52) U.S. Cl.
CPC ..... *E04C 5/08* (2013.01); *C22C 38/00* (2013.01); *E04B 1/16* (2013.01); *E04C 5/01* (2013.01);
(Continued)

(58) Field of Classification Search
CPC ..... E04C 5/08; E04C 5/07; E04C 5/01; E04B 1/16; E04G 23/0218; E04G 21/12; C22C 38/00
(Continued)

(56) References Cited

U.S. PATENT DOCUMENTS 5,093,065 A * 3/1992 Creedon ..... B28B 23/043 264/228
2005/0231071 A1* 10/2005 Magnussen ..... H01L 41/0906 310/328
2015/0218797 A1* 8/2015 Scherer ..... C22C 38/02 52/704

FOREIGN PATENT DOCUMENTS

GB 2358880 A 8/2001
WO 96/12588 A1 5/1996

OTHER PUBLICATIONS

International Search Report for PCT/CH2014/000030 in German, mailed Feb. 4, 2015.
(Continued)

*Primary Examiner* — Basil Katcheves
*Assistant Examiner* — Joshua Ihezie
(74) *Attorney, Agent, or Firm* — Cardinal Law Group

(57) ABSTRACT

The invention relates to a method according to which a profile consisting of a shape-memory alloy is placed into concrete, or a concrete to be reinforced is roughened on the outside, then profiles (2) consisting of a shape-memory alloy are fastened to the roughened outside (9) of the structure (6) and a cementitious matrix is applied to the roughened outside (9) to cover the profiles (2). After the cementitious
(Continued)

Figure 1:
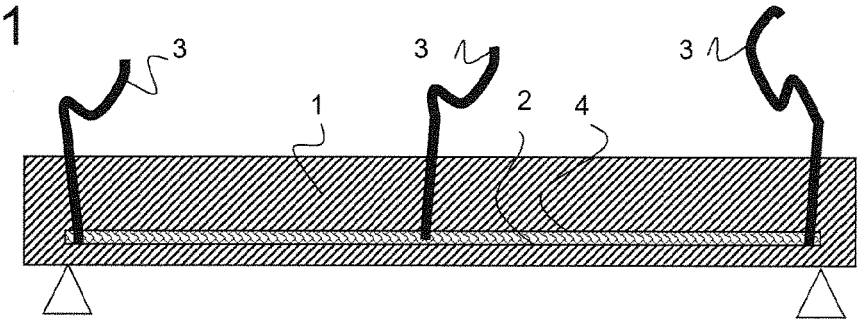

matrix has set, said profiles (2) produce a contraction force and thus a tension as a result of the input of heat. The mortar covering layer (16) thereby acts as a reinforcement layer owing to the interlocking of the mortar covering layer (16) with the roughened outside (9) of the structure (6). The profiles (2) run in an outer mortar as a reinforcement layer (16) of the outside of a structure along the outside of the structure inside the mortar or reinforcement layer (16). A structure can also be prepared for a prestress in the equipped mortar or reinforcement layer by the input of heat, in that electrical cables (3) are routed from the end regions thereof to the outside of the mortar or reinforcement layer (16) or the end regions of the electrical cables (3) are accessible by removing inserts (5).

18 Claims, 5 Drawing Sheets

(51) Int. Cl.

| | |
|---|---|
| ***E04C 5/01*** | (2006.01) |
| ***C22C 38/00*** | (2006.01) |
| ***E04G 23/02*** | (2006.01) |
| ***E04B 1/16*** | (2006.01) |
| ***E04C 5/07*** | (2006.01) |

(52) U.S. Cl.
CPC ..... *E04C 5/07* (2013.01); *E04G 21/12* (2013.01); *E04G 23/0218* (2013.01)

(58) Field of Classification Search
USPC ..... 52/223.14, 749.13
See application file for complete search history.

(56) References Cited

OTHER PUBLICATIONS

Written Opinion for PCT/CH2014/000030 in German.
International Search Report for PCT/CH2014/000030 in English, mailed Feb. 4, 2015.
Written Opinion for PCT/CH2014/000030 in English.

* cited by examiner

METHOD FOR BUILDING PRESTRESSED CONCRETE STRUCTURES BY MEANS OF PROFILES CONSISTING OF A SHAPE-MEMORY ALLOY, AND STRUCTURE PRODUCED USING SAID METHOD

This invention relates to a method to create prestressed concrete structural elements in new constructions (poured on-site at the construction site) or in the prefabrication as well as for the subsequent reinforcement of existing structures by means of cement-bound mortar in which profiles made from shape-memory alloys, among experts often referred to as shape-memory alloy profiles, or SMA-profiles in short, are placed for the purpose of prestressing. This prestressing system also makes it possible to attach subsequent additions to an existing structure under prestress. Additionally, the invention also relates to a concrete structure that was built or subsequently reinforced by using this method and where additions were docked to, respectively, according to this method. A special feature hereby is the fact that steel-based shape-memory alloys are used in the form of profiles to generate a prestress.

A prestress within a structure generally increases its fitness for use in that cracks become smaller or the formation of cracks is actually prevented. Such a prestress is already being used today for reinforcement against the bending of concrete parts or for strapping purposes, for instance, of columns to increase the axial load and to strengthen the shear, respectively. Another application of the prestress of concrete are tubes to transport liquids and silos and tanks, respectively, which are tied up to generate a prestress. Round steel or cables are placed in the concrete or afterwards externally secured on the tensile side on the surface of the structural element in prior art for prestressing purposes. The anchoring and transmission of power from the prestressed element to the concrete is very expensive in all these known methods. High costs are incurred for anchoring elements (anchor heads). As far as external prestress is concerned, prestressed steel and cables, respectively must also be protected against corrosion by means of a coating. This is necessary because traditionally used steel is not corrosion-resistant. When the prestressed cables are placed in the concrete, they must be protected against corrosion at a high cost by means of cement mortar that is inserted in the duct through injection. An external prestress is also generated in prior art with fibre-reinforced composites which are affixed to the surface of concrete. In this case, the fire protection is often very expensive since the adhesives exhibit a low glass transition temperature. The corrosion protection is the reason for the fact that a minimal covering of the steel reinforcements of approx. 3 cm must be adhered to in traditional concrete. As a result of environmental influences (namely $CO_2$ and $SO_2$ in the air), carbonation occurs in concrete. The basic environment in concrete (pH-value 12) drops to a lower value, i.e. a pH-value of 8 to 9, due to this carbonation. The corrosion protection of the traditional steel is no longer guaranteed if the internal reinforcement lies in this carbonated area. Accordingly, the 3 cm thick covering of the steel guarantees a corrosion resistance for the internal reinforcement during a service life of the structure of approx. 70 years. The carbonation is substantially less critical when using the novel shape-memory alloy since the novel shape-memory alloy exhibits a clearly higher corrosion resistance in comparison with common construction steel. Due to the fact that the concrete part and mortar, respectively, are prestressed, cracks are closed and the penetration of pollutants is sharply reduced accordingly. The concrete covering can be greatly reduced with the new development and, accordingly, structural elements such as balcony projections, balcony parapets, pipes, etc. can have thinner dimensions. Consequently, the structural elements become lighter and more economical in their use.

Hence, the task of the present invention is to create a method to prestress new concrete structures and concrete structural elements or cement-bound mortar mixes for the reinforcement of existing structures and, alternatively, for the purpose of improving the fitness for use and stability of the structure, to guarantee a more flexible use of the building for subsequent projecting additions or to increase the durability as well as fire resistance of the structure. In addition, the task of the invention is to specify a concrete structure that exhibits generated prestresses or reinforcements by applying this method.

The task is initially solved by a method to create prestressed concrete structures by means of profiles made from a shape-memory alloy, be it of new concrete structures and concrete structural elements or of cement-bound mortar mixes for the reinforcement of existing structures, characterised by the fact that profiles made from steel-based shape-memory alloy of polymorphic and polycrystalline structure with ribbed surface or with a thread-shaped surface, which can be brought from its state as martensite to its permanent state as austenite by increasing its temperature, are placed in the concrete or the cement-bound mortar mix and, alternatively, with additional end anchors so that these generate contraction force and thus tension either as a result of a subsequent active and controlled input of heat with heating media or through the impact of heat in case of fire and, accordingly, generate a prestress on the concrete and mortar mix, respectively, whereby the power is transmitted through the surface structure of the profile and/or through the end anchors of the profile.

Furthermore, the task is solved by a concrete structure, which is built by using one of the preceding methods, characterised in that it contains profiles made from a shape-memory alloy in new concrete or in an applied mortar mix as reinforcement layer of an outside of the structure, which run along the outside of the structure within the mortar mix and/or reinforcement layer and are prestressed or are prepared for a prestress through the input of heat, in that electrical cables run from their end areas from the mortar mix and reinforcement layer, respectively, or their end areas are accessible by removing inserts.

The method is described and explained on the basis of drawings. Applications in new construction and in prefabrication, respectively, as well as applications for the subsequent reinforcement of existing concrete constructions are described and clarified.

Figure 2:
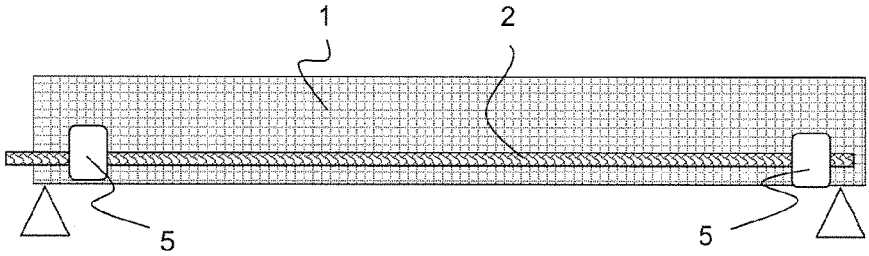
Figure 3:
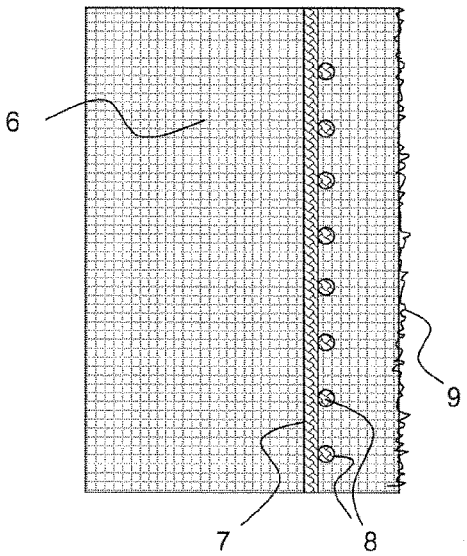
Figure 4:
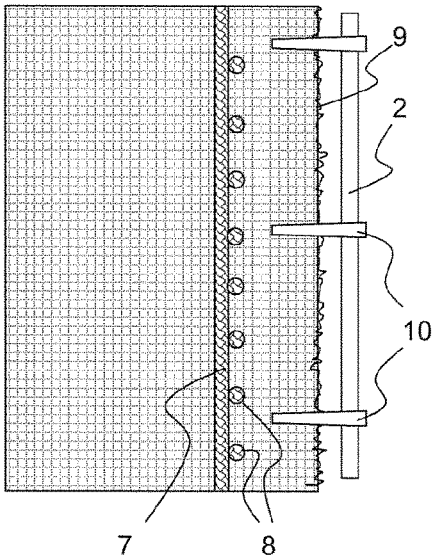
Figure 5:
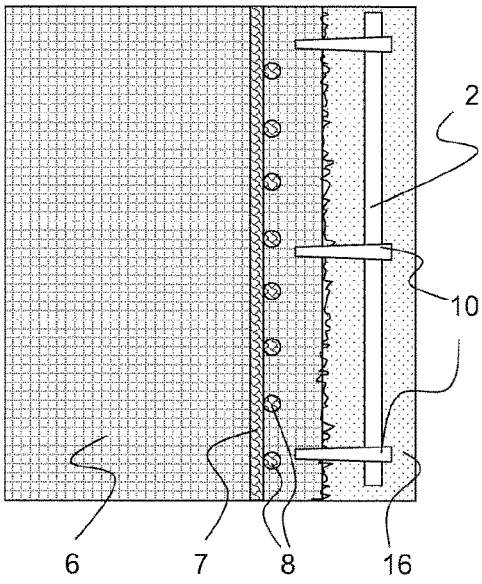
Figure 6:
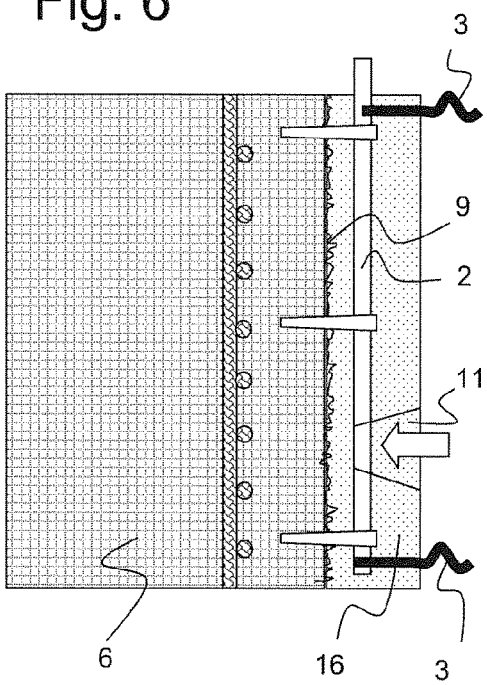
Figure 7:
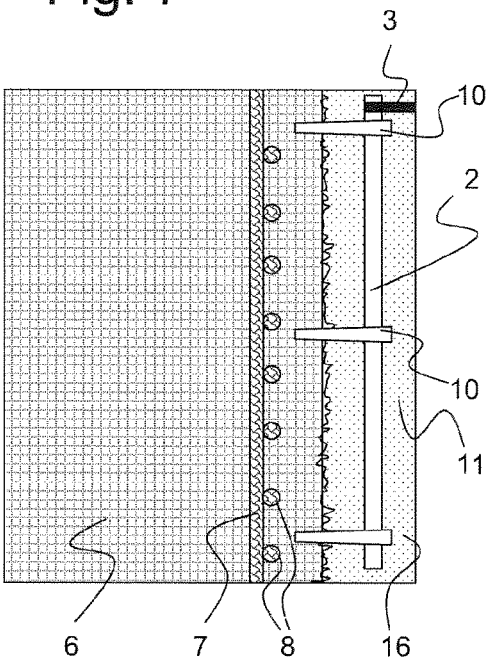
Figure 8:
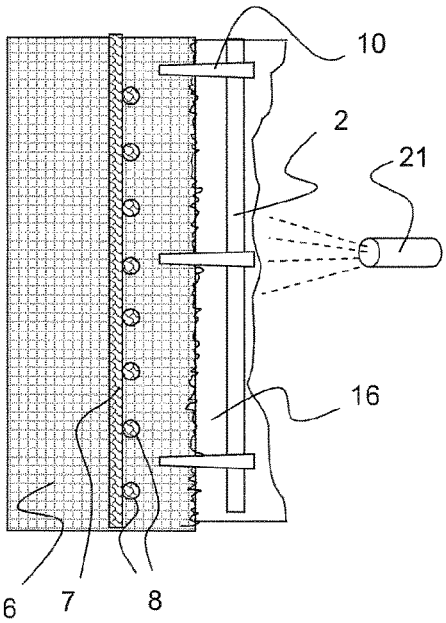
Figure 9:
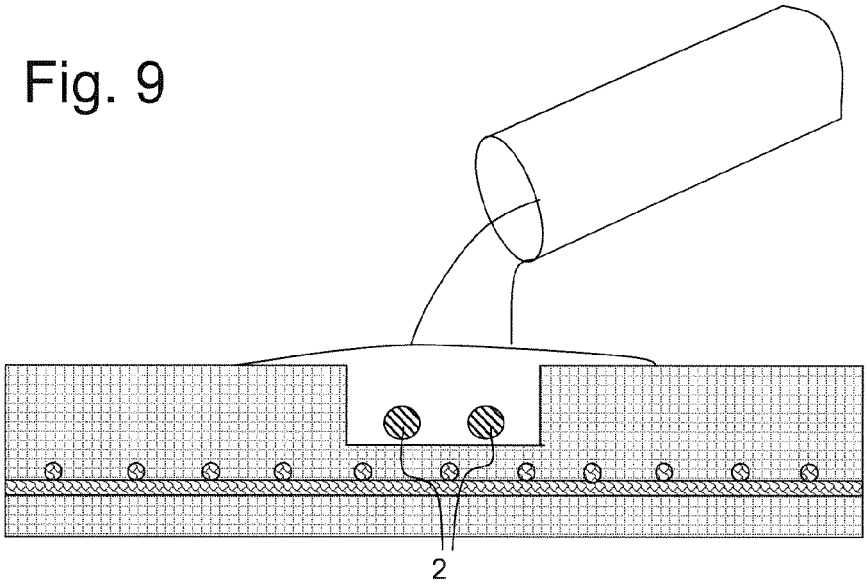
Figure 10:
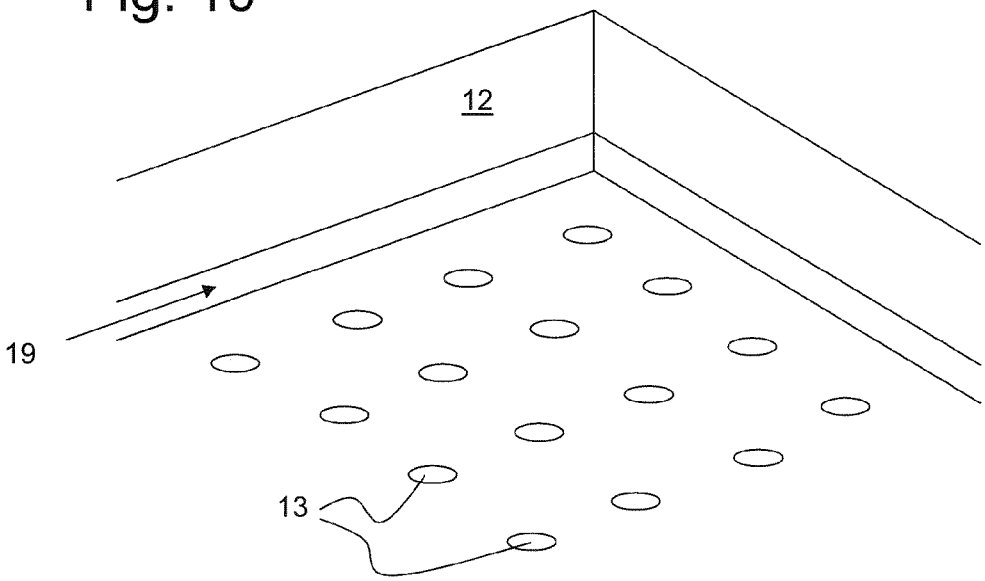
Figure 11:
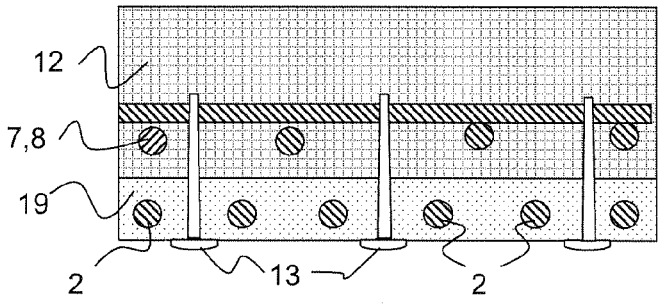
Figure 12:
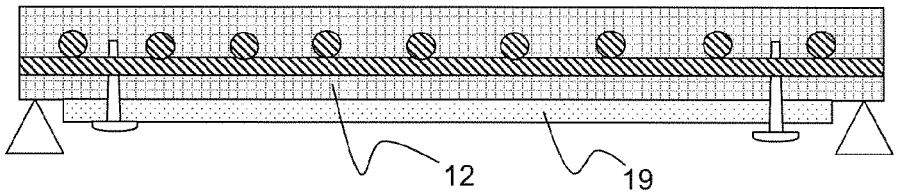
Figure 13:
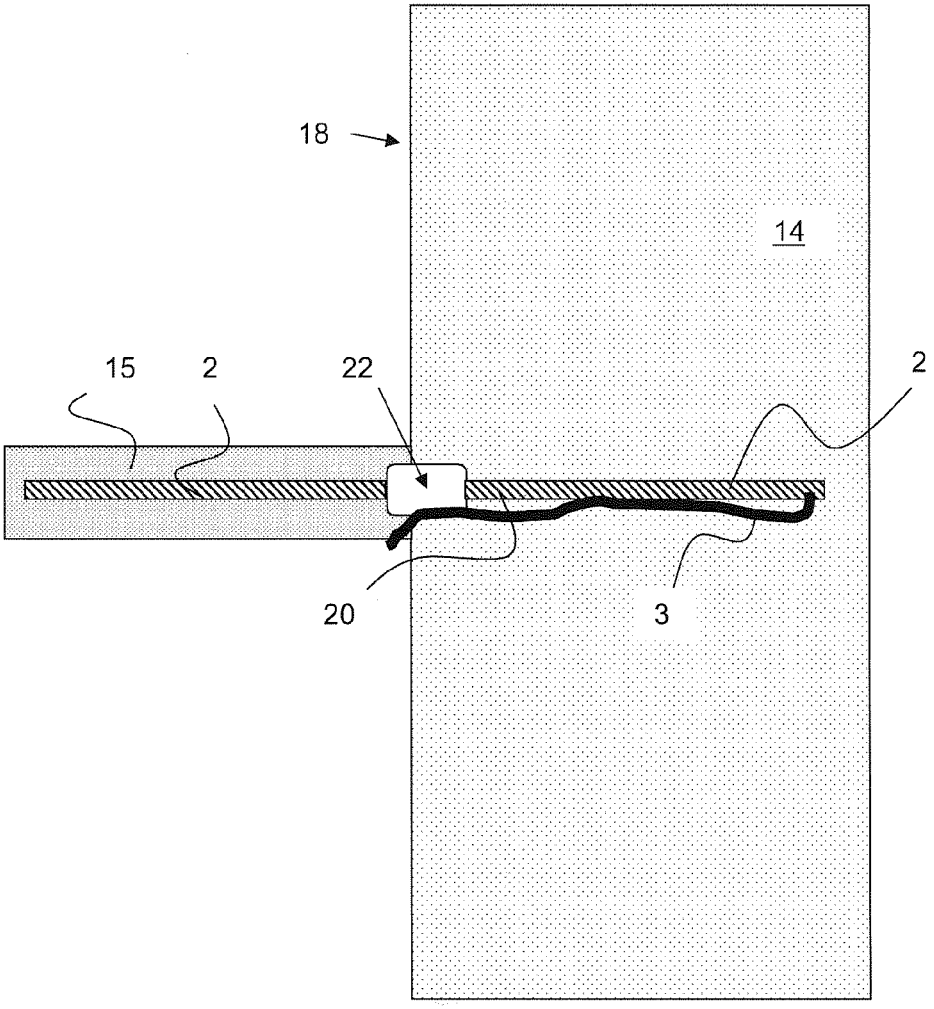

The figures show the following:

FIG. 1: A concrete support or a concrete slab casted at the construction site or in the prefabrication plant with inserted electrically heatable shape-memory alloy profiles;

FIG. 2: A concrete support casted at the construction site or in the prefabrication plant with inserted shape-memory alloy profile of which both ends are surrounded by padding;

FIG. 3: A cross-section of a concrete structure with internal traditional steel reinforcement which is prepared for the application of a mortar mix as reinforcement layer that contains shape-memory alloy profiles;

FIG. 4: A cross-section of the wall of this structure according to FIG. 3 after installing shape-memory alloy profiles;

FIG. 5: A cross-section of the wall of this structure according to FIGS. 3 and 4 after covering the installed shape-memory alloy profiles with shotcrete or cement mortar;

FIG. 6: A cross-section of the wall of this structure according to FIGS. 3 and 4 with the cast-in and covered shape-memory alloy profiles with two variants for the input of heat to warm up the profiles a) through electrical resistance heating through cast-in electrical cables or b) through a recess to connect electrical cables;

FIG. 7: A cross-section of the wall of this structure according to FIGS. 3 to 6 with the cast-in and covered shape-memory alloy profiles after the input of heat and filling the access points to the profiles;

FIG. 8: A cross-section of an existing concrete structural element (wall of the structure) which is reinforced with a shape-memory alloy profile on the surface when applying a cementitious layer by means of shotcrete/sprayed mortar;

FIG. 9: A cross-section of an existing concrete structural element which is reinforced with a shape-memory alloy profile on the surface when manually applying a cementitious layer;

FIG. 10: A cut-out of a concrete slab that is equipped with a dowelled and prestressed reinforcement layer on its underside and contains shape-memory alloy profiles;

FIG. 11: A cross-section through the existing concrete slab according to FIG. 10 with the conventional armouring as well as the mortar mix which is dowelled and prestressed over the entire surface as a reinforcement layer with shape-memory alloy profiles;

FIG. 12: An existing concrete slab with mortar mix applied at the bottom afterwards as a reinforcement layer with shape-memory alloy profiles inside, and which is only dowelled locally on both ends of the profile;

FIG. 13: A projecting concrete slab with shape-memory alloy profiles on the inside that was attached to a concrete structure, which had been prepared with previously set shape-memory alloy profiles for this during the building process.

At first, the nature of shape-memory alloys must be understood. These are alloys that exhibit a certain structure that changes depending on the heat but returns to its original state after heat is released. Just like other metals and alloys, these shape-memory alloys (SMA) contain more than just a crystalline structure. They are polymorphic and thus polycrystalline metals. The dominant crystalline structure of the shape-memory alloys (SMA) depends on its temperature, on the one hand, and on the external stress, on the other hand, be it tension or compression. The alloy is called austenite when the temperature is high and martensite when the temperature is low. The particular aspect of these shape-memory alloys (SMA) is the fact that they assume their initial structure and shape after increasing the temperature during the high temperature phase even when they were previously deformed during the low temperature phase. This effect can be utilised to apply prestress forces in building structures.

When no heat is artificially inserted into or released from the shape-memory alloy (SMA), the alloy is at ambient temperature. The shape-memory alloys (SMA) are stable within a specific temperature range, i.e. their structure does not change within certain limits of mechanical stress. Applications in the outdoor building sector are subject to the fluctuation range of the ambient temperature from −20° C. to +60° C. The structure of a shape-memory alloy (SMA) that is used here should not change within this temperature range. The transformation temperatures at which the structure of the shape-memory alloy (SMA) changes can vary considerably depending on the composition of the shape-memory alloy (SMA). The transformation temperatures are also load-dependent. Increasing mechanical stress of the shape-memory alloy (SMA) also implies increasing transformation temperatures. These limits must be given serious consideration when the shape-memory alloy (SMA) should remain stable within certain stress limits. If shape-memory alloys (SMA) are used for building reinforcements, it is imperative to consider the fatigue characteristics of the shape-memory alloy (SMA) in addition to the corrosion resistance and relaxation effects particularly when the loads vary over time. A differentiation is made between structural fatigue and functional fatigue. Structural fatigue relates to the accumulation of microstructural defects as well as the formation and expansion of superficial cracks until the material finally breaks. Functional fatigue, on the other hand, is the result of gradual degradation of either the shape-memory effect or the absorption capacity due to microstructural changes in the shape-memory alloy (SMA). The latter is associated with the modification of the stress-strain curve under cyclic load. The transformation temperatures are also changed in the process.

Shape-memory alloys (SMA) are suitable for absorbing permanent loads in the building sector on the basis of iron (Fe), manganese (Mn) and silicium (Si) wherein the addition of up to 10% of chrome (Cr) and nickel (Ni) makes the SMA react similarly against corrosion like stainless steel. Literature provides us the information that the addition of carbon (C), cobalt (Co), copper (Cu), nitrogen (N), niobium (Nb), niobium-carbide (NbC), vanadium-nitrogen (VN) and zirconium-carbide (ZrC) can improve the shape-memory characteristics in different ways. A shape-memory alloy (SMA) made from Fe—Ni—Co—Ti exhibits particularly good characteristics because it can absorb loads of up to 1000 MPa, is highly resistant to corrosion and its top temperature to change to the state of austenite is approx. 100° C.

The present reinforcement system takes advantage of the characteristics of shape-memory alloys (SMAs) and preferably those of a shape-memory alloy (SMA) based on considerably more corrosion-resistant steel in comparison with structural steel because such shape-memory alloys (SMAs) are considerably less expensive than some SMAs made from nickel titanium (NiTi). The steel-based shape-memory alloys (SMAs) are used in the form of round steel with raw surfaces, for example with coarse thread surfaces and are embedded in a mortar mix, i.e. a mortar layer, which functions as a reinforcement layer afterwards because of an indentation with concrete beneath it. The alloy contracts permanently to its original state on dissipation of heat. SMA-profiles will assume their original form and will also retain it under load when they are heated to the temperature that changes them to the state of austenite. The effect that is obtained here is the fact that the shape-memory alloy profiles, which have been casted into the mortar mix and mortar layer, respectively, generate a prestress on the entire hardened mortar mix and mortar layer, respectively, after being heated as a result of the reverse formation of its shape-memory alloy (SMA) that is prevented by embedding in concrete, wherein this prestress extends evenly and linearly, respectively, to the entire length of the shape-memory alloy profile.

In principle, a shape-memory alloy steel profile, an SMA steel profile in short, preferably made from round steel with a ribbed surface or with a coarse thread as surface is used in new construction or in prefabrication instead of traditional reinforced steel or, in addition to that, is placed in the concrete according to this method. The power supply heats the SMA steel profile after the concrete has hardened. This results in a shortening of the SMA steel profile and causes a prestress on the hardened concrete part accordingly. Subsequent reinforcement is obtained by installing the SMA steel profile in any direction but primarily in the tensile direction towards the roughened surface of the concrete structure and is dowelled with the same and afterwards enclosed and covered over the entire surface with cement mortar or shotcrete. After the cementitious mortar mix and mortar layer, respectively, have hardened, the SMA steel profiles are heated by means of electricity, which results in the shortening of these SMA steel profiles. This shortening causes a prestress of the cementitious mortar mix and mortar layer, respectively. The forces are then transmitted from the mortar layer into the existing concrete as a result of the raw surface of the concrete structure and adhesion.

The prefabrication of armoured concrete parts, for example balcony or façade slabs or pipes in which the novel SMA steel profiles are placed and prestressed, offers further advantages. The cross-sections of the structural element can be reduced thanks to the prestress of these prefabricated concrete structural elements. Since the structural element is designed free from cracks as a result of internal prestress, it is a lot more protected against the penetration of chloride and carbonation, respectively. That is, such structural elements become not only lighter but also a lot more resistant and durable accordingly.

The invention can also be used to better protect a structure in case of fire which is why the direct contraction of the SMA steel profiles due to the input of heat is at first consciously omitted. However, the built-in SMA steel profiles contract because of the effect of heat from a fire. Consequently, a concrete building envelope that was reinforced with SMA steel profiles, automatically generates a prestress in case of fire and results in an improvement of the resistance to fire.

The method is described and explained hereinafter on the basis of figures. For this purpose, FIG. 1 shows a cross-section of a concrete slab or concrete support 1. One or multiple SMA steel profiles 2 are embedded therein. Steel-based SMA profiles 2 with a polymorphic and polycrystalline structure, with a ribbed or otherwise structured surface or with a thread as surface are used each time. These SMA steel profiles can change from their state of martensite to their permanent state of austenite when their temperature is increased. Such a structural element can be built on-site at the construction site or in a prefabrication. The built-in SMA profiles 2 in the form of round steel exhibit a rough surface structure 4 so that they can absorb the same inside the concrete. The SMA steel profiles 2 are heated through the input of heat after the concrete, in which the SMA steel profiles V were casted, has hardened. This is accomplished advantageously with electricity by incorporating resistance heating as a voltage is applied to cast-in heating cable 3 so that SMA steel profile 2 heats up as a conductor. Since the calefaction by means of electrical resistance heating would require too much time and too much heat would then enter the concrete when the SMA profile bars are long, multiple electrical connections are set up over the length of the SMA profile bar. The SMA steel profile can then be heated by stages as a voltage is applied to two neighbouring heating cables and afterwards to the next cables adjacent to those, etc. until the entire SMA profile bar takes on the state of austenite. High voltages and amperages are temporarily required for this so that a common line voltage of 220V/110V and a voltage source of 500V, which are often supplied at construction sites, are insufficient. In fact, the voltage is supplied by a mobile energy unit that is used for construction sites which generates the voltage with a number of lithium batteries connected in series with sufficiently thick power cables so that a current with high amperage can be sent through the SMA steel profile. The heating process should only last a short duration so that the necessary temperature of approx. 150° to 300° is reached in the SMA steel profile 2 within 2 to 5 seconds and thus contraction force is generated. The fact that the subsequent concrete suffers damage is hereby avoided. Two conditions must be met for this; firstly, about 10-20 A is required per $mm^2$ of cross-sectional area and, secondly, about 10-20V is required per 1 m of profile bar length in order for the profile bar to reach the state of austenite within seconds. The batteries must be connected in series. The quantity, size and type of batteries must be selected accordingly so that the required current (amperage) and the required voltage (volt) is available. The energy consumption must be regulated by a control system so that at the push of a button—adapted to a certain profile steel length and profile steel thickness—power is supplied to the profile bar precisely for the correct time periods and the necessary current flows. The heating process can take place by stages when profile bars are multiple meters in length by providing electrical connections after certain sections, i.e. from which heating cables lead from the structural element to be built to the open air where the voltage can then be applied. The necessary heat can thus be introduced step by step over the entire length of a profile bar before finally bringing the entire length to the state of austenite.

FIG. 2 shows a cross-section of an alternative design of such a concrete structural element. The end regions of the SMA steel profiles are wrapped with inserts 5, which reach until the surface of concrete element 1, to introduce the heat after the concrete has hardened. These inserts 5 can, for instance, be pieces of wood that are put over the end regions of the SMA round steel 2 or pieces of styrofoam or the like. These inserts 5 can be removed after the concrete has hardened and then the access to the end regions of the SMA steel profiles 2 is uncovered. These can subsequently be heated as the electrical cables of the energy unit are connected to these end regions using large-scale terminals. Alternatively, the immediate input of heat is not needed. Such a concrete element 1 is preconditioned to some extent. If the impact of heat from a fire takes place at a later time, SMA profiles 2 will generate contraction force and thus tension and generate a prestress of the concrete, which results in a considerable improvement of the fire resistance of the building. For all intents and purposes, this is clipped together all around in case of fire and will collapse much later, if at all.

FIGS. 3 to 9 present a further application, namely the creation of a reinforcement layer in a building. FIG. 3 shows a cross-section of a structure wall 6 which, in turn, is traditionally reinforced with a conventional reinforcement 7, 8. Outside 9 of structure wall 6 is raw in design or roughened afterwards. This can, for instance, be accomplished by means of wet sandblasting. The hydromechanical adaptation with the high-pressure water jet is a better alternative. Different systems with various water quantities and water pressures from at least 500 bar to 3000 bar are put into practice. The desired roughness of the concrete surface of minimum 3 mm is guaranteed with such systems. Additionally, the application of hydromechanics guarantees that the substrate concrete is saturated with water under capillary pressure. This is a condition for proper adhesion between the existing concrete and the new cement-based mortar layer to be applied.

FIG. 4 shows how SMA profiles 2 in the form of round steel are attached to raw surface 9 with an appropriate alloy. These can be secured in the concrete wall with dowels 10. Dowels 10 can also reach behind the first reinforcement 7, 8 as required. Both end regions of individual SMA profiles 2 are each connected with electrical cables 3. Although only a single SMA profile 2 is visible here, which extends vertically, it is obvious that SMA profiles 2 that run horizontally or even in any direction can be obstructed as is shown by the reinforcement of rebars 8 that run horizontally in concrete wall 6 and cross rebars 7 running vertically.

Next, the SMA profiles, as shown in FIG. 5, are completely wrapped by applying shotcrete or cement mortar, by spraying, pouring in or coating. The cement mortar can also be applied manually.

As shown in FIG. 6, a recess 11 is apparent in a spot at SMA profile 2 in which an insert 5 had been introduced. SMA profile 2 is exposed where the insert had been removed after the concrete or mortar had hardened. The input of heat then takes place using a heating cable, which is to be connected there by means of a terminal, in combination with another heating cable that is connected to the SMA profile at a similar recess through a terminal. This is where SMA profile 2 is supplied with voltage through both indicated heating cables 3 so that resistance heating is generated. The heating process results in contraction force of SMA profiles 2 that generate tension and thus a prestress of the entire mortar mix and reinforcement layer 16, respectively, and their prestress is transferred to the same through the interlocking with rough surface 9 of concrete wall 6. Overall, the structure is reinforced considerably.

FIG. 7 shows a cross-section of this wall of the structure after generating contraction force and tension of SMA profiles 2 within the mortar mix and reinforcement layer 16, respectively. Recess 11, which was used for the input of heat, is now filled with cement mortar. As far as heating cables 3 are concerned, these are cut away flush with the surface.

FIG. 8 shows a cross-section of a steel-reinforced structure wall 6 which is reinforced at a vertical outside with a sprayed layer and, in turn, prestressed by means of SMA profiles 2. To this end, a lattice made from SMA profiles 2 is attached to the roughened surface of concrete 6 by means of suitable dowels 10. Afterwards, this lattice is coated and covered by means of shotcrete released from a spray gun 21, as is shown here. After this shotcrete has hardened, SMA profiles 2 of the lattice contract due to the input of heat so that the entire layer of shotcrete is prestressed as reinforcement layer 21. The generated prestress is transferred to structure 6 through the interlocking with the roughened surface of this structure and essentially increases its stability and its resistance to fire.

FIG. 9 shows an application on a horizontal concrete slab. This is where these SMA profiles 2 can be cast with manually filled flow mortar after placing SMA profile 2 on the roughened surface of the concrete slab. When cementitious poured mortar is used, it must still be compacted or vibrated with a trowel. Alternatively, self-compacting and self-levelling cementitious mortar can be used. Afterwards, cast-in SMA profiles 2 are heated through the input of heat and generate an area-wide prestress of the mortar layer that transfers to the concrete slab.

FIG. 10 shows a cut-out of a concrete slab 12, namely a corner of the same in a perspective view seen from below which is provided with a dowelled and prestressed reinforcement layer 19 on its bottom side that contains SMA profiles. Reinforcement layer 19, which contains SMA profiles as described, has a force-lock connection with concrete slab 12 by means of a multitude of dowels 13. The SMA profiles are only made to generate contraction force and thus tension through the input of heat after completed doweling and a force-locked connection is established between concrete slab 12 and the hardened mortar or concrete layer that should act as reinforcement layer 19 and in which the SMA profiles are located, so that reinforcement layer 19 is prestressed and this prestress transfers to concrete slab 12 through the doweling and connection.

FIG. 11 shows the internal composition of this reinforcement with a cross-section through concrete slab 12 according to FIG. 10 with the conventional reinforcement made from reinforced steel 7,8 as well as reinforcement layer 19 dowelled and prestressed thereon with SMA profiles 2. The bottom side of concrete slab 12 is rough and SMA profiles 2 are embedded in sprayed reinforcement layer 19. After the concrete has hardened, it will be dowelled by means of long concrete dowels 13 that reach until the first reinforcement 7,8 in concrete slab 12. SMA profiles 12 are then prestressed and this prestress transfers to reinforcement layer 19 and from there through the interlocking with the rough surface of concrete slab 12 and dowelling on the same. Concrete slab 12 that is prestressed like this exhibits a considerably higher load-bearing capacity and thus existing concrete slabs can be reinforced efficiently from the bottom.

FIG. 12 shows a concrete beam with a subsequently applied reinforcement layer 19 that is dowelled on both ends. The prestress should only act in one direction in this application, namely between both support points of the concrete beam.

FIG. 13 shows another interesting application. A structure with SMA profiles 2 embedded in concrete or common reinforced steel is prestressed here. The outer end of the reinforcement that points against the outside of the building is equipped with a coupling body 22. When using SMA profiles 2, an electrical cable 3 leads to the rear end of SMA profile 2 embedded in concrete. These coupling bodies 22 can, for instance, be double nuts. These are embedded in concrete and only covered with a little bit of concrete. If a projecting concrete slab 15 needs to be docked to structure 14, the coupling bodies 22 will be exposed and concrete slab 15, in which SMA profiles 2 were casted, is connected to concrete structure 14. To this end, SMA profiles 2 that project from this structure and are provided with a rough thread in the end region are tightly connected or bolted down with the SMA profiles or common rebars by means of coupling bodies 22. The space between structure 14 and projecting concrete slab 15 is filled after this mechanical coupling. After the filling has hardened, heat is introduced in SMA profiles 2 through electrical cables 3 so that contraction force and tension are generated. This prestresses the entire system, i.e. projecting concrete slab 15 is prestressed internally and tightened to structure 14 by means of a prestress, and when the reinforcements that go inside the structure are also SMA profiles 2, they will also generate a prestress inside structure 14 which, overall, will result in higher stability and load-bearing capacity of the projection.

The invention claimed is:

1. A method to create prestressed concrete structures by means of profiles made from a shape-memory alloy, be it on an outside of a new or existing concrete structure, characterised by the fact that a. the outside of the structure to be reinforced or a recess (FIG. 9) in the outside is roughened, b. profiles (2) made from a steel-based shape-memory alloy of polymorphic and polycrystalline structure with a ribbed or thread-shaped surface, which can be taken from a temporary condition as martensite to a permanent condition as austenite by increasing the temperature of the profiles (2), are attached to the roughened outside (9), c. capillary saturation of the outside with water is generated and a cementitious matrix is applied to the roughened outside as mortar mix to cover the profiles (2), d. following hardening of the cementitious matrix into a mortar matrix layer, the profiles (2) are made to generate a contraction force and thus tension through input of heat, as a result of which the mortar mix layer is prestressed as a reinforcement layer (16,19), whereby the contraction force is transmitted to the concrete or mortar mix (1) through the ribbed or thread-shaped surface of the profile (2), through the mortar matrix layer, and to the roughened outside.

2. A method to create prestressed concrete structures by means of profiles made from a shape-memory alloy according to claim 1, characterised by the fact that in step a, the profiles (2) are attached to the roughened outside (9) of the structure (6,12) with additional end anchors and in step d, force is also transmitted to the mortar mix (1) through the additional end anchors.

3. A method to create prestressed structures by means of profiles made from a shape-memory alloy according to claim 1, characterised by the fact that in step a, the outside of the structure to be reinforced (6,12) or the recess (FIG. 9) in the outside is roughened hydromechanically with a pressure of at least 500 bar or by means of sand blasting up to a surface roughness of minimum 3 mm so that a top layer of the outside forming an underground is saturated with water, in step b, the profiles (2) are attached to the roughened outside (9) by means of anchors or steel profiles, in step c, the cementitious matrix as the mortar mix is applied to the roughened outside by hand, by spraying as dry sprayed concrete, or by applying coats of self-levelling flow mortar when the roughened outside is horizontal.

4. A method to create prestressed concrete structures by means of profiles made from a shape-memory alloy according to claim 1, characterised by the fact that the profiles (2), for the purpose of heat input from a voltage source in the form of an energy unit from a row of serially linked batteries through fixed or temporarily connected electrical cables (3), are put under an electrical potential of 10-20 V per m of profile length to generate a current of 10-20 A per $mm^2$ of cross-section area for resistance heating and are brought from the temporary condition as martensite to the permanent condition as austenite within 2 to 10 seconds.

5. A method to create prestressed concrete structures by means of profiles made from a shape-memory alloy according to claim 4, characterised by the fact that multiple electrical connections with outward leading heating cables are provided across the length of the profile and the input of heat is generated step by step through application of voltage at two neighbouring electrical connections at any one time.

6. A concrete structure built by using the method according to claim 1.

7. A concrete structure built by using the method according to claim 2.

8. A concrete structure built by using the method according to claim 3.

9. A concrete structure built by using the method according to claim 4.

10. A concrete structure built by using the method according to claim 5.

11. A method to create prestressed structures by means of profiles made from a shape-memory alloy according to claim 2, characterised by the fact that in step a, the outside of the structure to be reinforced (6,12) or the recess (FIG. 9) in the outside is roughened hydromechanically with a pressure of at least 500 bar or by means of sand blasting up to a surface roughness of minimum 3 mm so that a top layer of the outside forming an underground is saturated with water, in step b, the profiles (2) are attached to the roughened outside (9) by means of anchors or steel profiles, in step c, the cementitious matrix as the mortar mix is applied to the roughened outside by hand, by spraying as dry sprayed concrete, or by applying coats of self-levelling flow mortar when the roughened outside is horizontal.

12. A method to create prestressed concrete structures by means of profiles made from a shape-memory alloy according to claim 2, characterised by the fact that the profiles (2), for the purpose of heat input from a voltage source in the form of an energy unit from a row of serially linked batteries through fixed or temporarily connected electrical cables (3), are put under an electrical potential of 10-20 V per m of profile length to generate a current of 10-20 A per $mm^2$ of cross-section area for resistance heating and are brought from the temporary condition as martensite to the permanent condition as austenite within 2 to 10 seconds.

13. A method to create prestressed concrete structures by means of profiles made from a shape-memory alloy according to claim 3, characterised by the fact that the profiles (2), for the purpose of heat input from a voltage source in the form of an energy unit from a row of serially linked batteries through fixed or temporarily connected electrical cables (3), are put under an electrical potential of 10-20 V per m of profile length to generate a current of 10-20 A per $mm^2$ of cross-section area for resistance heating and are brought from the temporary condition as martensite to the permanent condition as austenite within 2 to 10 seconds.

14. A concrete structure built by using the method according to claim 11.

15. A concrete structure built by using the method according to claim 12.

16. A concrete structure built by using the method according to claim 13.

17. A method to create prestressed structures by means of profiles made from a shape-memory alloy according to claim 1, characterised by the fact that in step d, after the hardening of the applied mortar mix into the mortar matrix layer and before the input of heat, the mortar mix layer (16,19) is dowelled by applying dowels (13) which extend behind a front concrete reinforcement (7,8) of the structure (12) behind the mortar mix layer (16,19).

18. A method to create prestressed structures on an outside of a new or existing concrete structure, the method comprising:

roughening the outside;

attaching a profile to the roughened outside, the profile being made from a shape-memory alloy having an elongated state and a shortened state, the attached profile being in the elongated state;

saturating the roughened outside with water;

applying a cementitious matrix to the saturated roughened outside to cover the profile;

allowing the cementitious matrix to harden into a mortar matrix layer; and heating the profile to transform the covered attached profile to the permanent state and stress the mortar matrix layer.

* * * * *